US009328486B2

(12) United States Patent
Chong et al.

(10) Patent No.: US 9,328,486 B2
(45) Date of Patent: May 3, 2016

(54) MULTIPOSITIONAL FAUCET SPOUT

(71) Applicant: Elkay Manufacturing Company, Oak Brook, IL (US)

(72) Inventors: Jonathan Chee Yeen Chong, Chicago, IL (US); René G. Laude, Elgin, IL (US); Raymond T. Hecker, Elmhurst, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 239 days.

(21) Appl. No.: 13/967,000

(22) Filed: Aug. 14, 2013

(65) Prior Publication Data

US 2014/0048145 A1 Feb. 20, 2014

Related U.S. Application Data

(60) Provisional application No. 61/683,472, filed on Aug. 15, 2012.

(51) Int. Cl.

| | |
|---|---|
| ***F15B 13/00*** | (2006.01) |
| ***F16K 21/00*** | (2006.01) |
| ***F16K 5/00*** | (2006.01) |
| ***F16K 27/00*** | (2006.01) |
| ***F16K 43/00*** | (2006.01) |
| ***F16L 55/18*** | (2006.01) |
| ***F16K 51/00*** | (2006.01) |
| ***E03B 1/00*** | (2006.01) |
| ***E03C 1/086*** | (2006.01) |
| ***E03C 1/04*** | (2006.01) |

(52) U.S. Cl.

CPC ..... *E03C 1/0404* (2013.01); *E03C 2001/0414* (2013.01); *Y10T 137/0402* (2015.04); *Y10T 137/6014* (2015.04); *Y10T 137/87579* (2015.04); *Y10T 137/9464* (2015.04)

(58) Field of Classification Search

CPC ..... E03C 1/0404; E03C 2001/0414; Y10T 137/6014; Y10T 137/87579; Y10T 137/9464; F16L 27/08; F16L 27/0804

USPC ..... 137/315.12, 603, 801; 4/675–678; 285/282, 394

See application file for complete search history.

(56) References Cited

U.S. PATENT DOCUMENTS

| | | | | |
|---|---|---|---|---|
| 1,841,737 | A | 1/1932 | Judell | |
| 2,324,741 | A | 7/1943 | Svabek, Jr. | |
| 2,878,059 | A | 3/1959 | Limle | |
| 4,009,731 | A | 3/1977 | Denz | |
| 4,262,699 | A | 4/1981 | Fabian | |
| 4,565,395 | A * | 1/1986 | Rockwood | F16B 7/1427 248/415 |

(Continued)

*Primary Examiner* — John K Fristoe, Jr.
*Assistant Examiner* — Kelsey Rohman
(74) *Attorney, Agent, or Firm* — Leydig, Voit & Mayer, Ltd.

(57) ABSTRACT

A faucet that permits an installer to select any of a plurality of desired spout rotational ranges of the spout with respect to the faucet base. The faucet can include adjustable components that allow the installer to select a degree of rotation of the spout with respect to the base. The degree of rotation can be any suitable range between 0° and 360°, inclusive, in either the clockwise or counterclockwise direction. When the degree of rotation is 360°, the spout may rotate through multiple rotations of 360°. In some embodiments, the installer can choose between a preselected number of rotational ranges. In other embodiments, the selectable range of rotation is variable and the installer can select between a desired suitable range.

13 Claims, 16 Drawing Sheets

(56) References Cited

U.S. PATENT DOCUMENTS

| | | | |
|---|---|---|---|
| 4,856,122 | A | 8/1989 | Pilolla |
| 6,615,422 | B2 | 9/2003 | Hecker |
| 2006/0157127 | A1 | 7/2006 | Bors et al. |
| 2006/0157128 | A1 | 7/2006 | Frackowiak et al. |
| 2006/0162795 | A1 | 7/2006 | Gloor et al. |
| 2008/0099091 | A1 | 5/2008 | Benstead |

* cited by examiner

MULTIPOSITIONAL FAUCET SPOUT

CROSS-REFERENCE TO RELATED APPLICATION

This patent application claims the benefit of U.S. Provisional Patent Application No. 61/683,472, filed Aug. 15, 2012, which is incorporated by reference in its entirety herein.

BACKGROUND

Standard faucets are manufactured to permit a single range of spout rotation upon installation. Thus, an installer and home owner must accept the manufacturer's selected range of faucet spout rotation.

BRIEF SUMMARY

A faucet is described that permits an installer to select any of a plurality of desired rotational ranges of the spout with respect to the faucet base. The faucet can include adjustable components that allow the installer to select a degree of rotation of the spout with respect to the base. The degree of rotation can be any suitable range between 0° and 360°, inclusive, in either the clockwise or counterclockwise direction. When the degree of rotation is 360°, the spout may rotate through multiple rotations of 360°. In some embodiments, the installer can choose between a preselected number of rotational ranges. In other embodiments, the selectable range of rotation is variable and the installer can select between any desired suitable range.

The faucet comprises a faucet base having an opening. A rotation-limiting element may be receivable in the opening. The rotation-limiting element has a first engagement structure which can include a first engagement surface. The faucet further comprises a spout with an end receivable in the opening. The end of the spout has a second engagement structure which may include a second engagement surface. A retainer, such as a collar, may surround the spout for retaining the spout and rotation-limiting element in the opening. The spout may be selectively rotatable within the retainer in a clockwise direction and a counter-clockwise direction from a first position where the first engagement structure is in contact with the second engagement structure, through a degree of rotation throughout which the first and second engagement structures are spaced a distance apart, to a second position where the first engagement structure is in contact with the second engagement structure. The degree of rotation may be varied by adjusting the distance the first and second engagement structures are spaced apart. The spout may be fully rotatable through 360° when the first and second engagement structures do not contact each other, and may be non-rotatable with respect to the base when the first and second engagement structures are maintained in contact.

A kit for a faucet installation is also described. The kit may comprise a faucet base having an opening and a rotation-limiting element receivable in the opening. The rotation-limiting element has a first engagement structure which may include a first engagement surface. The kit further comprises a spout with an end receivable in the opening. The end of the spout has a second engagement structure which may include a second engagement surface. A retainer, such as a collar, surrounds the spout for retaining the spout and the rotation-limiting element in the opening. The spout may be selectively rotatable within the retainer through a degree of rotation, and the degree of rotation may be varied by adjusting the distance the first and second engagement structures are spaced apart. A spacer is receivable in the opening below the rotation-limiting element. The spacer may be selected from one of a plurality of spacers, each with a different thickness or height and each corresponding to a different degree of rotation.

A method for installing a faucet is also described. The method comprises disposing a rotation-limiting element in an opening of a faucet base, the rotation-limiting element having a first engagement structure. The first engagement structure may include a first engagement surface. A spout may be disposed in the opening of the faucet base above the rotation-limiting element, the spout having a second engagement structure and being selectively rotatable in a clockwise and counter-clockwise direction. The second engagement structure may include a second engagement surface. The spout and the rotation-limiting element may be retained in the opening with a retaining structure, such as a collar, that surrounds the spout. A distance between the first engagement structure and the second engagement structure may be adjusted to vary a degree of rotation of the spout with respect to the faucet base. The spout may be fully rotatable through 360° when the first and second engagement structures do not contact each other, and may be non-rotatable with respect to the base when the first and second engagement structures are maintained in contact.

In a first embodiment, the faucet can include a base and a spout extending from the base. The spout may engage the base in a manner that provides flexibility in the selectable range of rotational movement of the spout. The base can have a cylindrical wall forming a cylindrical opening for receiving the spout. An adjusting nut can be provided that fits within and engages the opening. The adjusting nut can be raised and lowered within the opening. The spout may include a spout stop that can be received in the opening and that rests on the adjusting nut. The spout stop can include an engagement surface for engaging the spout to restrict rotation. The spout can have a spout end with its own engagement surface that can engage the spout stop to restrict rotation of the spout. The range of rotation of the spout with respect to the base can be chosen by the installer at the time of installation. In order to set the desired range of rotation, the installer can place the adjusting nut within the cylindrical opening. The spout stop can also be disposed in the cylindrical opening such that the spout stop rests on the adjusting nut. The adjusting nut can be raised or lowered to a desired position, which correspondingly raises or lowers the spout stop. The end of the spout can then be inserted into the cylindrical opening of the base and a collar can be used to retain the spout in place. The position of the spout stop with respect to the spout end determines the degree of rotation of the spout.

In a second embodiment, the spout can include a plurality of openings sized to receive an adjustment pin. The faucet base can include a multifunction sleeve and a housing sleeve. The multifunction sleeve can be disposed within an opening in the housing sleeve. The multifunction sleeve can be fixed with respect to the housing sleeve, and the housing sleeve can be fixed to the base. The top surface of the multifunction sleeve can have a plurality of stepped levels that can act as stops to permit different rotational ranges of motion for the spout. The different levels can each correspond to one of the plurality of openings in the spout, which allows the installer to select a desired range of rotation of the spout by inserting the adjustment pin in the desired opening of the spout. For example, when the adjustment pin is inserted into the opening in the spout to fit within a first level of the multifunction sleeve, the spout can rotate until the adjustment pin reaches a step up to another level which acts as a stop for the adjustment pin and the spout. The arc length of the level determines the distance over which the spout can rotate.

In a third embodiment, a spout sleeve can be attached to the spout and the faucet base can include an adjustment sleeve. The spout sleeve can be disposed within an opening in the adjustment sleeve. The spout sleeve can be fixed with respect to the spout, and the adjustment sleeve can be fixed to the base. The adjustment sleeve can include one or more openings for receiving an adjustment pin. The spout sleeve can also include one or more openings that receive the adjustment pin. The size of the openings in the spout sleeve can determine the permissible rotational range of motion of the spout with respect to the base. In order for the installer to select a desired range of rotation of the spout, the installer can insert the adjustment pin into an opening in the adjustment sleeve that corresponds to an opening in the spout sleeve that permits the desired range of rotation.

In a fourth embodiment, spout sleeve can be attached to the spout, and the faucet base can include an adjustment sleeve. The spout sleeve can be disposed within an opening in the adjustment sleeve. The spout sleeve can be fixed with respect to the spout, and the adjustment sleeve can be fixed to the base. The installer can be provided with a kit containing a plurality of spout sleeves that permit different ranges of rotational motion of the spout with respect to the base. The installer can select between the plurality of spout sleeves to choose the desired range of rotational motion. For example, spout sleeves can be provided that permit the spout to be fixed or permit rotation of 45°, 90°, or 360°. Each spout sleeve can have one or more vertically disposed insert slots that receive a corresponding tab on the inner surface of the adjustment sleeve. The sleeves that permit rotation movement of the spout have a horizontally disposed rotational slot that is perpendicular to the insert slot and sized to permit a desired degree of rotation of the spout with respect to the base.

In a fifth embodiment, the base can have a cylindrical wall forming a cylindrical opening for receiving the spout. A spacer can be provided that fits within the opening. A rotation-limiting element may also be provided. The rotation-limiting element can be received in the opening and can have a base surface that rests on the spacer. The rotation-limiting element can include a first engagement surface for engaging the spout to restrict rotation. The spout can have a spout end that can include a second engagement surface for engaging the rotation-limiting element to restrict rotation of the spout. The range of rotation of the spout with respect to the base can be chosen by the installer at the time of installation. In order to set the desired range of rotation, the installer can place a spacer in the cylindrical opening of the base. The spacer can be chosen from among a plurality of spacers of different thicknesses or heights. The rotation-limiting element can also be disposed in the cylindrical opening such that the rotation-limiting element rests on the spacer. The different thickness spacers permit the rotation-limiting element to be raised or lowered to a desired position within the cylindrical opening. The end of the spout can then be inserted into the cylindrical opening of the base. The position of the spout end with respect to the rotation-limiting element determines the degree of rotation of the spout with respect to the base. For example, the spacer can be selected to create varying amounts of separation between the first engagement surface of the rotation-limiting element and the second engagement surface of the spout end. Using a shorter spacer creates larger separation resulting in a greater degree of rotation of the spout. Using a taller spacer creates smaller separation resulting in a more limited degree of rotation of the spout. Thus, the range of permissible rotation is variable and the installer has flexibility in choosing a desired rotational range by selecting the appropriate spacer.

DETAILED DESCRIPTION

A faucet is described that has components permitting an installer to select a desired range of rotational motion of the faucet spout with respect to the faucet base. Accordingly, a suitable range of motion can be chosen based on user preference and/or sink configuration.

Figure 1:
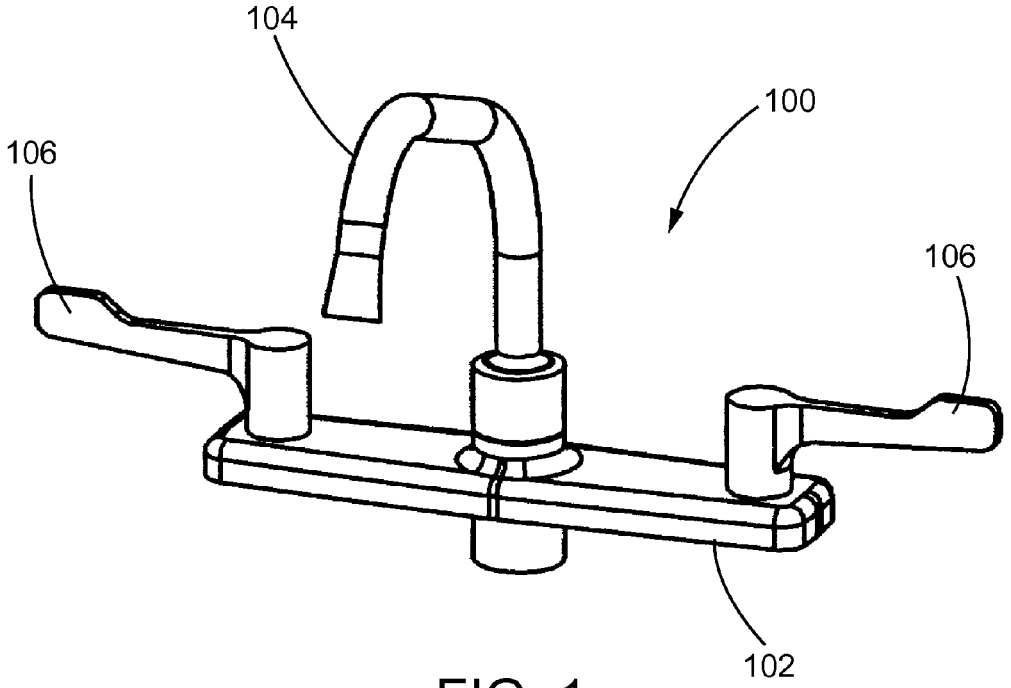
FIG. 1 is a perspective view of a first embodiment of a faucet.

Referring to FIG. 1, the faucet 100 can include a base 102 and a spout 104 extending from the base 102. The spout 104 can be connected to a water line for dispensing water from the spout 104 into a vessel, such as a sink. The spout 104 can have any suitable shape and size. The base 102 can be attached to a support structure, such as a counter. The base 102 can be any suitable shape and size. The faucet 100 can include one or more handles 106 that are attached to valves to control the temperature and flow rate of water through the spout 104. The handles 106 can be attached to the base 102.

Figure 2:
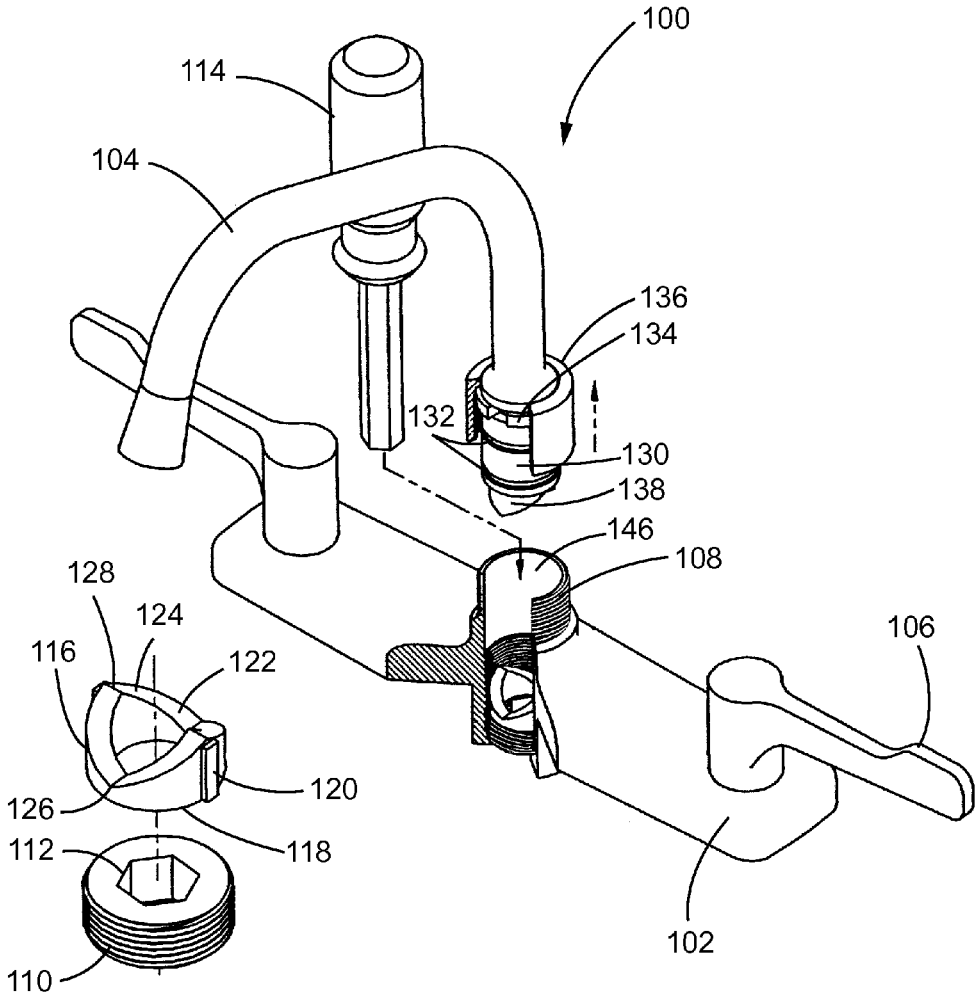
FIG. 2 is a an exploded perspective view of the faucet of FIG. 1.
Figure 3:
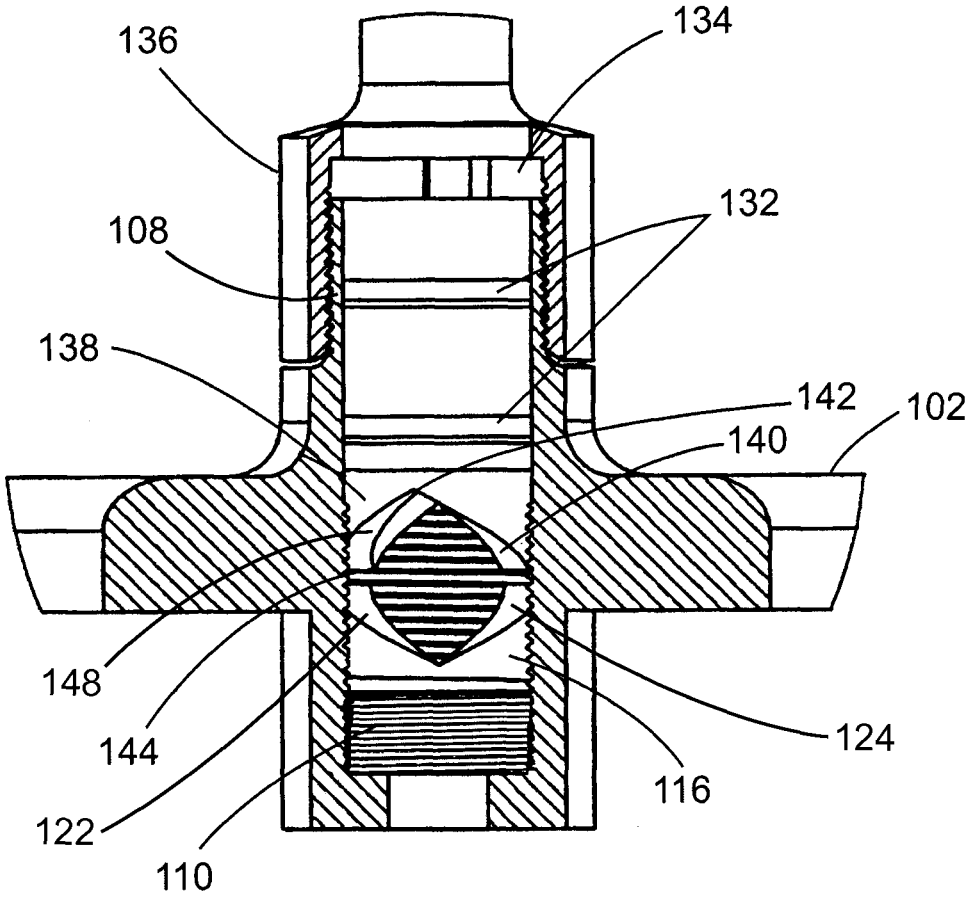
FIG. 3 is a partial sectional view of the faucet of FIG. 1.

The spout 104 may engage the base 102 in a manner that provides flexibility in the selectable range of rotational movement of the spout 104. In other words, the range of rotation can be variable such that the installer can select any suitable desired range of motion. Referring to FIGS. 2 and 3, the base 102 can have a cylindrical wall 108 forming an opening 146 for receiving the spout 104. The cylindrical wall 108 can include internal threads and/or external threads. The cylindrical wall 108 can include one or more grooves. An adjusting nut 110 can be provided that fits within the opening 146. The adjusting nut 110 can be externally threaded to engage the internal threads of the wall 108. The adjusting nut 110 can have a mating portion 112 for engaging an adjusting key 114 to raise and lower the adjusting nut 110. For example, the mating portion 112 can be a shaped opening, such as a hexagonal shaped opening.

A spout stop 116 may also be provided. The spout stop 116 can be received in the opening 146 and can have a base surface 118 that rests on the adjusting nut 110. The spout stop 116 can have one or more projections 120 that engage the one or more grooves in the wall 108 to properly orient the spout stop 116 and prevent the spout stop 116 from rotating. The groove(s) can slidably receive the projection(s) 120. The spout stop 116 can include an engagement structure which may include an engagement surface 122 for engaging the spout 104 to restrict rotation. The engagement surface 122 can have a curved ramp 124. The curved ramp 124 can change directions each quarter of a turn around the spout stop 116. Thus, for reference, when viewed from above and moving clockwise around the spout stop 116, the curved ramp 124 can alternate between slanting toward the base surface 118 and slanting away from the base surface 118 with an intersection between each change in direction forming a valley 126 or ridge 128. It will be appreciated, however, that the spout stop 116 can have any suitable shape and size to enable any suitable degree of rotation of the spout 104 with respect to the base 102.

The spout 104 can have a cylindrical outer surface 130 with one or more grooves for receiving O-ring seals 132 and a snap ring 134. A retainer, such as threaded collar 136, can be disposed over the spout 104. The threaded collar 136 can be screwed onto the external threads of the cylindrical wall 108 of the base 102. The collar 136 can contact the snap ring 134, which extends outward from the groove beyond the outer surface 130 of the spout 104, to retain the spout 104 to the base 102. The spout 104 can have a spout end 138 that can engage the spout stop 116 to restrict rotation of the spout 104.

As shown in FIG. 3, the spout end 138 can include an engagement structure which may include an engagement surface 148 for engaging the spout stop 116. The engagement surface 148 can have a curved ramp 140. The curved ramp 140 can change directions each quarter of a turn around the spout stop 116. Thus, for reference, when viewed from below and moving clockwise around the spout stop 116, the curved ramp 140 can alternate between slanting toward the spout 104 and slanting away from the spout 104 with an intersection between each change in direction forming a valley 142 or ridge 144. The shape of the curved ramp 140 of the spout end 138 can be the same as the curved ramp 124 of the spout stop 116, though the valleys and ridges can be offset by 90° as described below with respect to FIG. 8. It will be appreciated, however, that the spout end 138 can have any suitable shape and size to enable any suitable degree of rotation of the spout 104 with respect to the base 102.

As mentioned above, the range of rotation of the spout 104 with respect to the base 102 can be chosen by the installer at the time of installation. In order to set the desired range of rotation, the installer can perform the following steps. The adjusting nut 110 can be disposed in the cylindrical opening 146 of the base 102. The spout stop 116 can also be disposed in the cylindrical opening 146 such that the spout stop 116 rests on the adjusting nut 110. Using the adjusting key 114 to engage the adjusting nut 110, the adjusting nut 110 can be rotated to engage the internal threads in the base 102. This permits the adjusting nut 110 and spout stop 116 to be raised and lowered to a desired position. The end of the spout 104 can then be inserted into the cylindrical opening 146 of the base 102 and the collar 136 can be used to retain the spout 104 in place. The position of the spout stop 116 with respect to the spout end 138 determines the degree of rotation of the spout 104.

Figure 5:
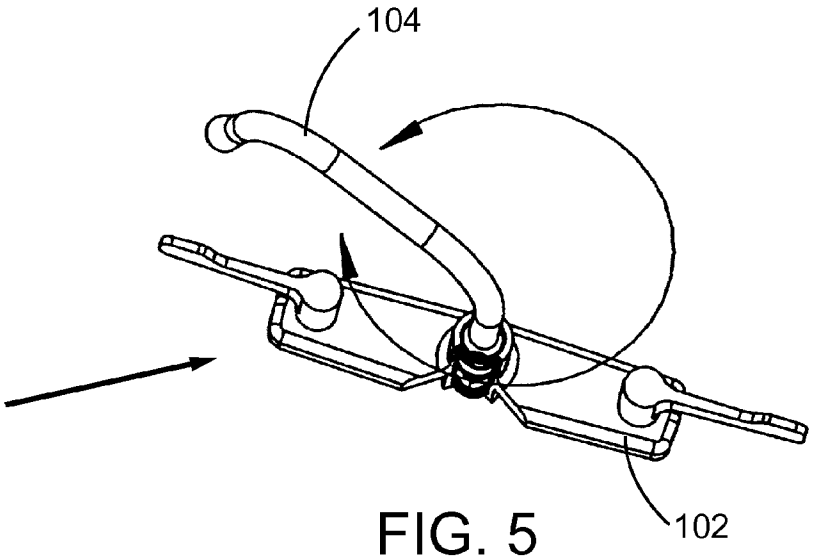
FIG. 5 is a perspective view of the faucet of FIG. 1 adjusted as shown in FIG. 4.
Figure 4:
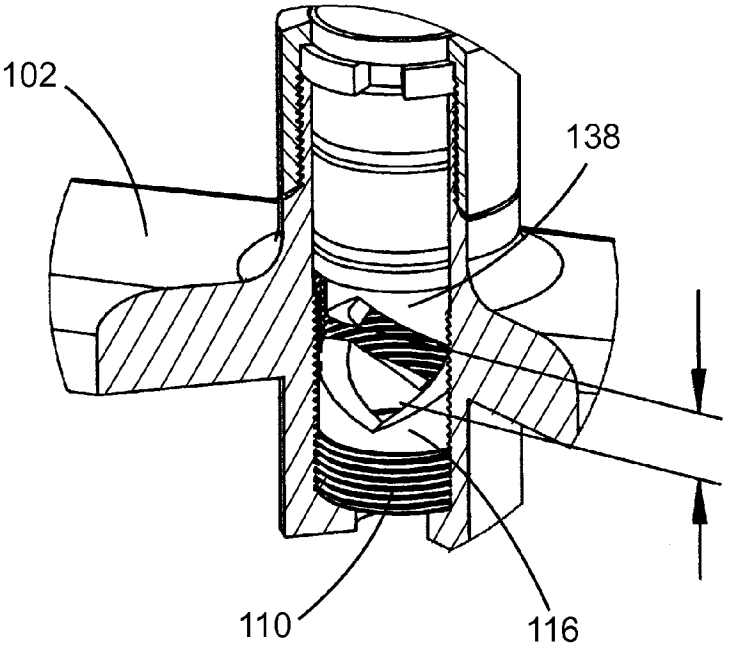
FIG. 4 is an enlarged fragmentary partial sectional view of the faucet of FIG. 1 adjusted to permit 360° rotation.

For example, referring to FIG. 4, the adjusting nut 110 can be lowered to an extent that creates a sufficiently large gap between the spout stop 116 and the spout end 138 such that the engagement surfaces 122, 148 of spout stop 116 and spout end 138 do not contact one another. In this configuration, the spout 104 can be rotated freely a full 360° with respect to the base 102, as shown in FIG. 5, in either the clockwise or counterclockwise direction and through multiple rotations of 360°.

Figure 7:
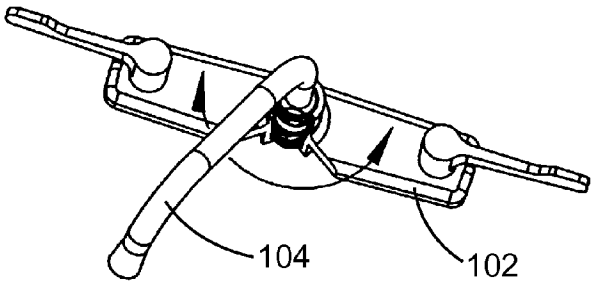
FIG. 7 is a perspective view of the faucet of FIG. 1 adjusted as shown in FIG. 6.
Figure 6:
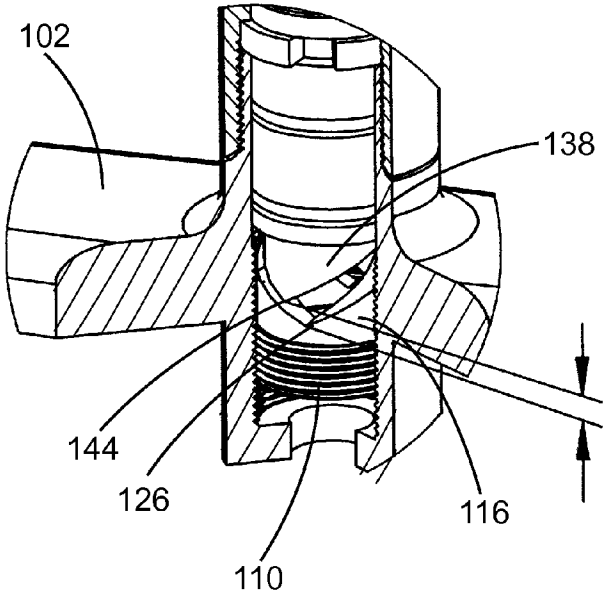
FIG. 6 is an enlarged fragmentary partial sectional view of the faucet of FIG. 1 adjusted to permit a degree of rotation between 0° and 180°.

Referring to FIG. 6, the adjusting nut 110 can be moved to a position that creates a gap between a ridge 144 on the spout end 138 and a valley 126 on the spout stop 116 that does not exceed the distance between the valley 126 and ridge 128 on the spout stop 116. The larger the gap, the greater the degree of rotation of the spout 104, and the smaller the gap, the smaller the degree of rotation of the spout 104. Thus, the range of permissible rotation is variable and the installer has flexibility in choosing a desired rotational range by adjusting the distance between the spout stop 116 and the spout end 138. In this configuration, the spout 104 can be rotated freely from 0° to 180° with respect to the base 102, as shown in FIG. 7.

Figure 9:
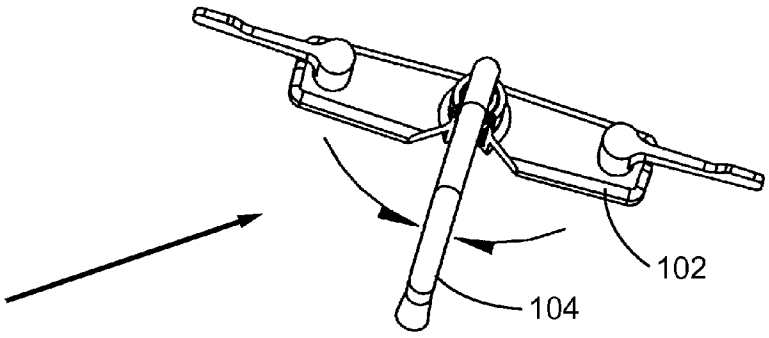
FIG. 9 is a perspective view of the faucet of FIG. 1 adjusted as shown in FIG. 8.
Figure 8:
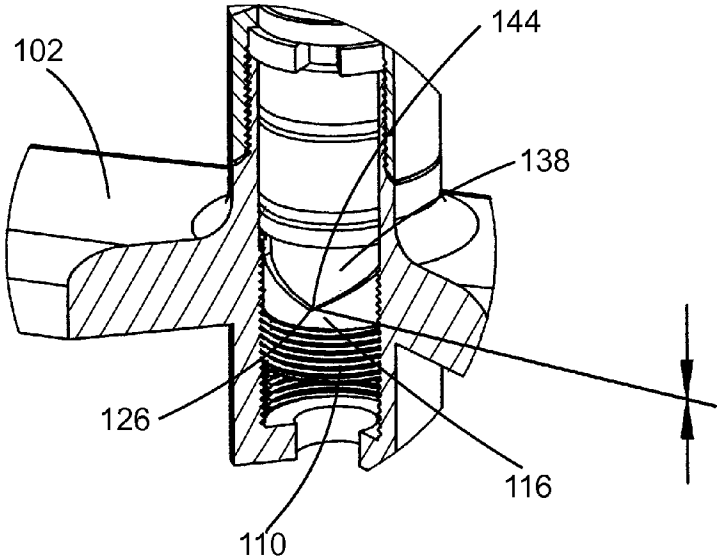
FIG. 8 is an enlarged fragmentary partial sectional view of the faucet of FIG. 1 adjusted to lock the spout to 0° rotation.

Referring to FIG. 8, when the adjusting nut 110 is raised to an extent that the complementary engagement surfaces 148, 122 of the spout end 138 and spout stop 116 are fully in contact with one another, e.g., there is no gap between a ridge 144 on the spout end 138 and a valley 126 on the spout stop 116, the spout 104 is fixed with respect to the base 102. In this configuration, the spout 104 cannot be rotated with respect to the base 102, as shown in FIG. 9.

Figure 10:
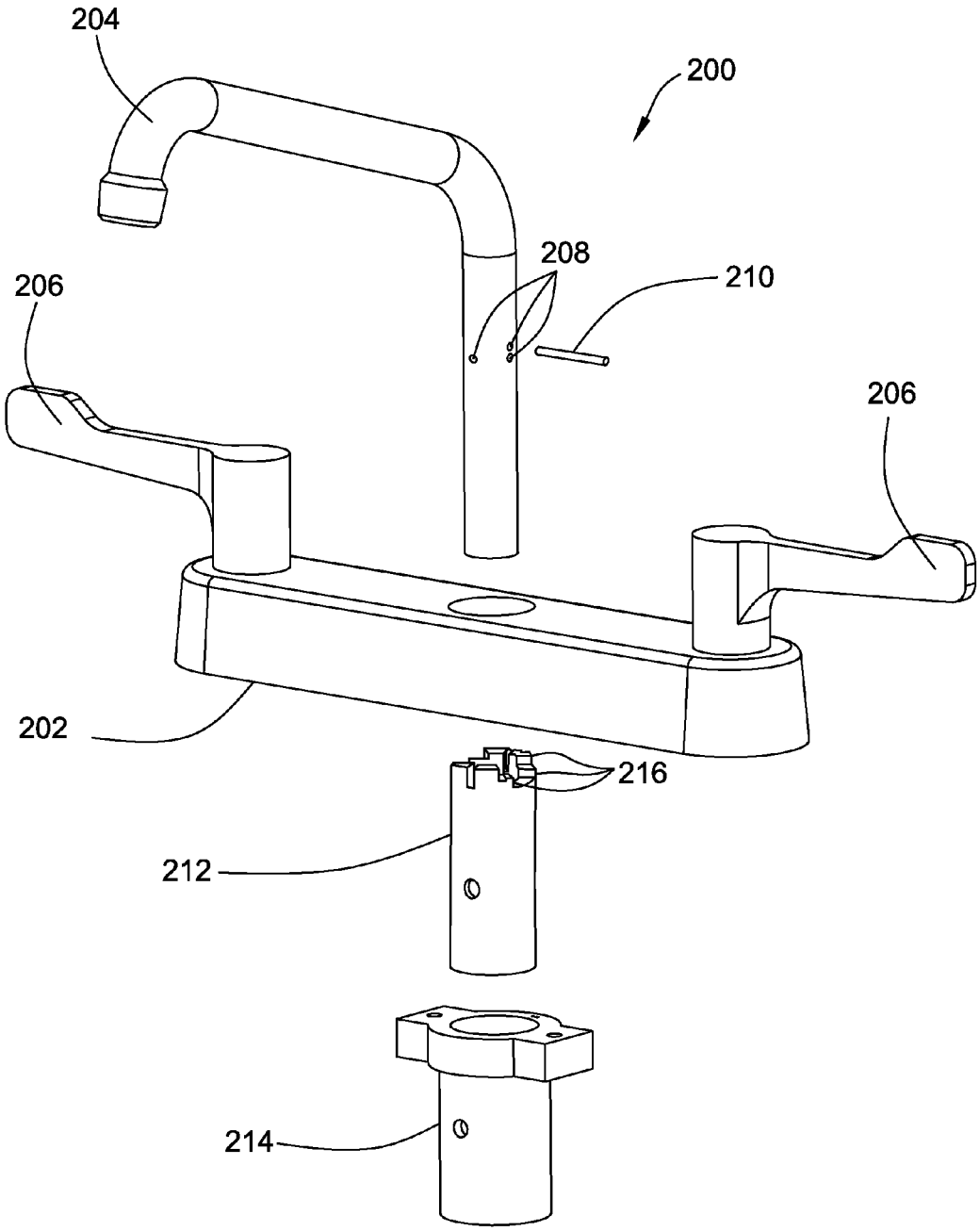
FIG. 10 is an exploded perspective view of a second embodiment of a faucet.

Turning to FIG. 10, another embodiment of a faucet 200 that can have a variable rotational range of motion of the spout 204 with respect to the base 202 chosen at the time of installation is shown. The spout 204 can include a plurality of openings 208 sized to receive an adjustment pin 210 which comprises an engagement structure. The faucet base 202 can include a multifunction sleeve 212 and a housing sleeve 214. The multifunction sleeve 212 can be cylindrical and can be disposed within an opening in the housing sleeve 214. The multifunction sleeve 212 can be fixed with respect to the housing sleeve 214, and the housing sleeve 214 can be fixed to the base 202.

Figure 11:
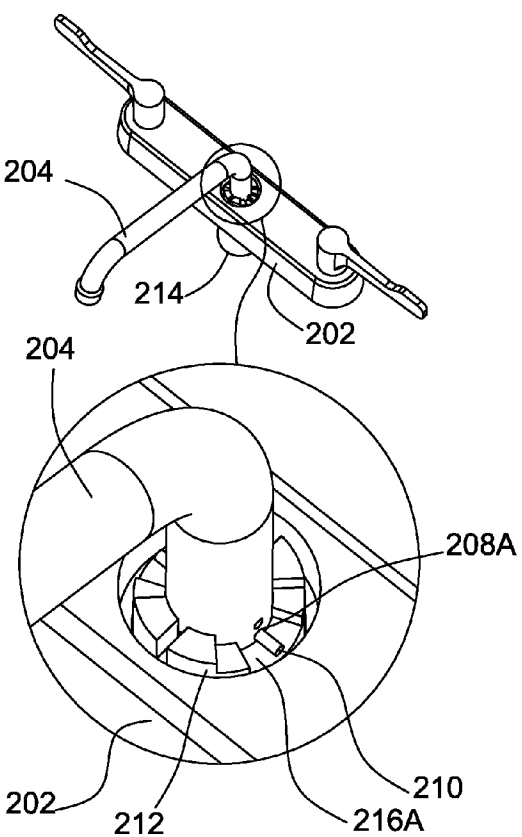
FIG. 11 is an enlarged fragmentary view of the faucet of FIG. 10 adjusted to permit 45° rotation.

The top surface of the multifunction sleeve 212 can have an engagement structure including a plurality of stepped levels 216 that can act as stops to permit different rotational ranges of motion for the spout 204. The different levels 216 can each correspond to one of the openings 208 in the spout 204, which allows the installer to select a desired range of rotation of the spout 204 by inserting the adjustment pin 210 in the desired opening 208 of the spout 204. For example, referring to FIG. 11, the adjustment pin 210 can be inserted into the lowermost opening 208A in the spout 204 to fit within a first level 216A of the multifunction sleeve 212. When the spout 204 is rotated, the adjustment pin 210 can move along the level 216A until it reaches a step up to another level which acts as a stop for the adjustment pin 210 and the spout 204. The arc length of each level 216, i.e., the distance between steps up to another level, determines the distance over which the spout 204 can rotate. The arc length of each level 216 can be determined by the manufacturer, and any suitable number of levels 216 can be provided on the multifunction sleeve 212 to provide the installer with any suitable number of rotational ranges of motion for the spout 204. By way of example, the spout 204 shown in FIG. 11 can rotate approximately 45° with respect to the faucet base 202.

Figure 12:
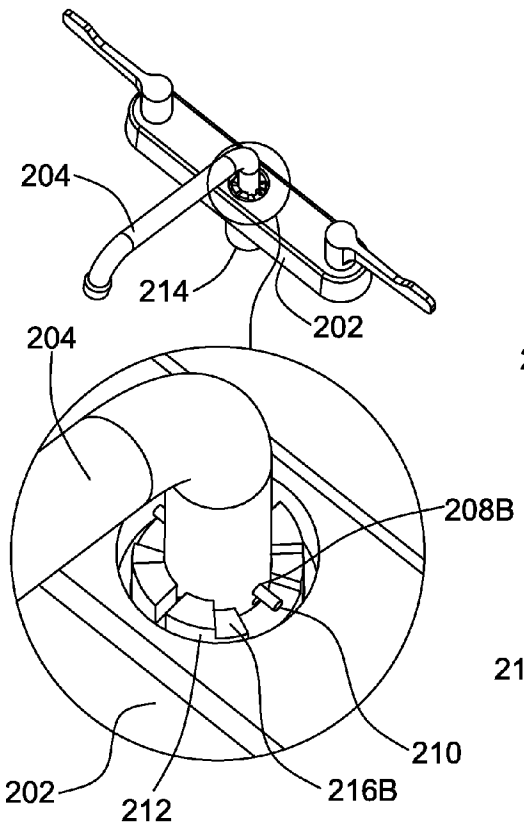
FIG. 12 is an enlarged fragmentary view of the faucet of FIG. 10 adjusted to permit 90° rotation.

As a further example, referring to FIG. 12, the adjustment pin 210 can be inserted into an opening 208B above the lowermost opening 208A in the spout 204 to fit within a second level 216B of the multifunction sleeve 212. When the spout 204 is rotated, the adjustment pin 210 can move along the level 216B until it reaches a step up to another level which acts as a stop for the adjustment pin 210 and the spout 204. By way of example, the spout 204 shown in FIG. 12 can rotate approximately 90° with respect to the faucet base 202.

Figure 13:
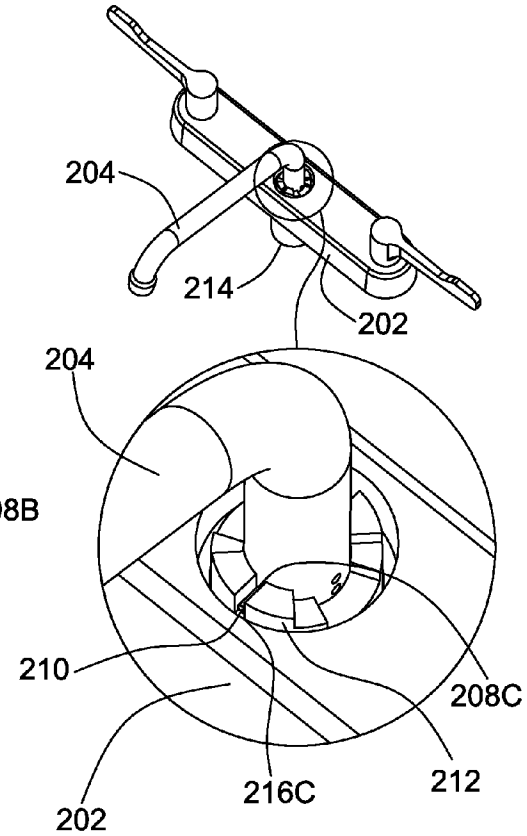
FIG. 13 is an enlarged fragmentary view of the faucet of FIG. 10 adjusted to lock the spout to 0° rotation.

In addition, the spout 204 can be fixed with respect to the multifunction sleeve 212. As shown in FIG. 13, the multifunction sleeve 212 can have a groove 216C and the spout 204 can have an opening 208C to receive the adjustment pin 210 at a position corresponding to the groove 216C. The width of the groove 216C can sized to snugly accommodate the width of the adjustment pin 210 such that the adjustment pin 210 can be received in the groove 216C and prevent rotational movement of the spout 204. The opening 208C in the spout 204 to fix the movement of the spout 204 can be at a position approximately 90° from the position of the opening(s) in the spout 204 that permit rotation (e.g., 208A, 208B). However, it will be appreciated that the openings 208 in the spout 204 can be disposed in any suitable position on the spout 204 to engage any suitable portion of the multifunction sleeve 212 to permit any suitable rotational range of the spout 204 with respect to the base 202 or to prevent rotation. The spout 204 can include sealing means to prevent seepage when the adjustment pin 210 is received in one of the plurality of openings 208. For unrestricted 360° rotation of the spout 204 with respect to the base 202 in either the clockwise or counterclockwise direction, the adjustment pin 210 can be left out of the spout 204 and is not inserted therein. In this configuration, the spout 204 may be rotatable through multiple rotations of 360°.

Figure 14:
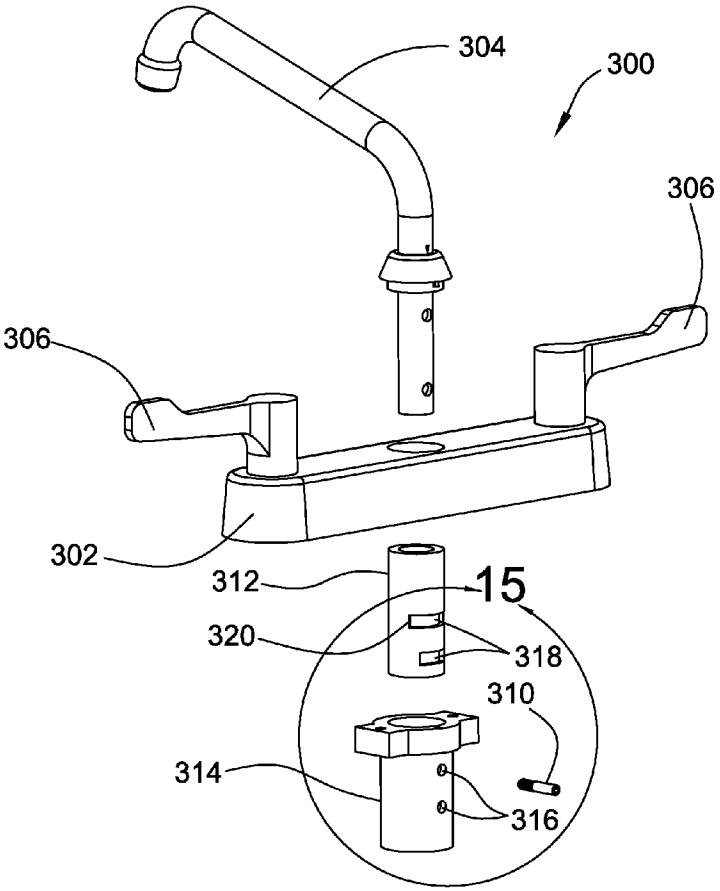
FIG. 14 is an exploded perspective view of a third embodiment of a faucet.

Another embodiment of a faucet 300 that can have the rotational range of motion of the spout 304 with respect to the base 302 chosen at the time of installation is shown in FIG. 14. A spout sleeve 312 can be attached to the spout 304, and the faucet base 302 can include an adjustment sleeve 314. The spout sleeve 312 can be cylindrical and disposed within an opening in the adjustment sleeve 314. The spout sleeve 312 can be fixed with respect to the spout 304, and the adjustment sleeve 314 can be fixed to the base 302.

Figure 15:
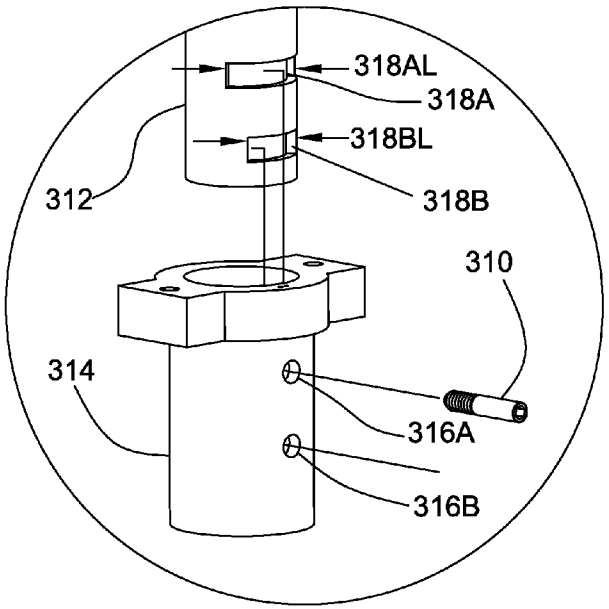
FIG. 15 is an enlarged exploded perspective view of a spout sleeve, adjustment sleeve, and adjustment pin for the faucet of FIG. 14.
Figure 17:
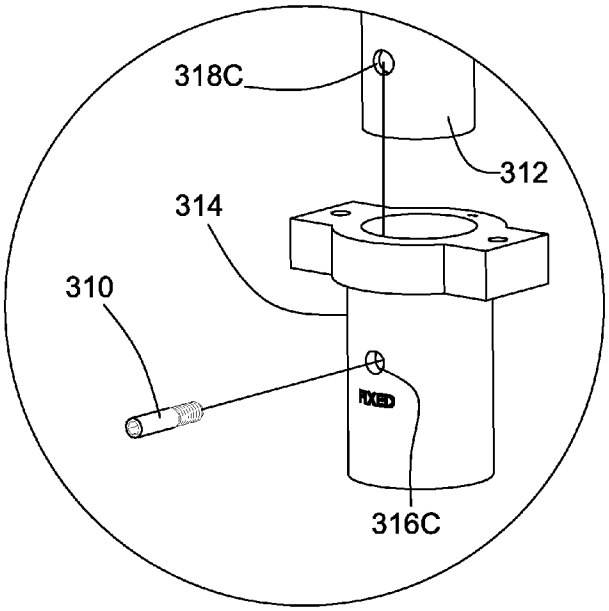
FIG. 17 is an enlarged exploded perspective view of a spout sleeve, adjustment sleeve, and adjustment pin for the faucet of FIG. 16.
Figure 16:
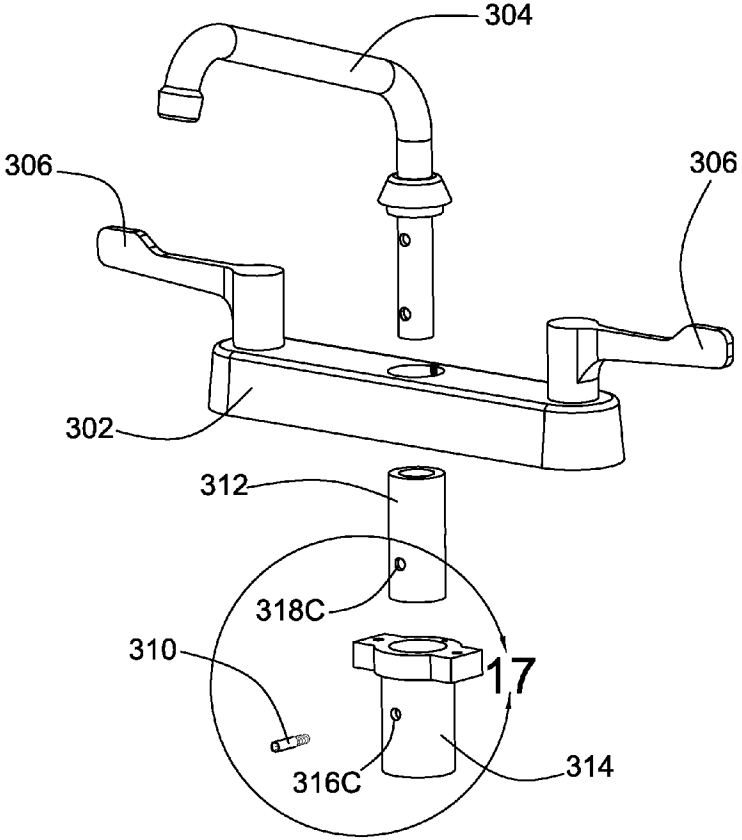
FIG. 16 is another exploded perspective view of the faucet of FIG. 14.

Referring to FIGS. 14-17, the adjustment sleeve 314 can include one or more openings 316 for receiving an adjustment pin 310 comprising an engagement structure. The spout sleeve 312 can also include an engagement structure having one or more openings 318 (two of which are shown in FIGS. 14-15), some of which can be slots, that receive the adjustment pin 310. The length of the openings 318 in the spout sleeve 312 can determine the permissible rotational range of motion of the spout 304 with respect to the base 302. When the spout sleeve opening 318 is a slot, the adjustment pin 310 can move within the slot 318 to permit rotation of the spout 304. The edges 320 at each end of the slot 318 serve as stops when the adjustment pin 310 contacts them. When the spout sleeve opening 318 is circular, as shown in FIGS. 16-17, and sized to closely surround the adjustment pin 310, the spout 304 can be fixed in position with respect to the base 302.

For example, referring to FIG. 15, in order for the installer to select a desired range of rotation of the spout 304, the installer can insert the adjustment pin 310 into an opening 316 in the adjustment sleeve 314 that corresponds to an opening 318 in the spout sleeve 312 that permits the desired range of rotation. As shown, the adjustment pin 310 can be inserted into the opening 316A of the adjustment sleeve 314 corresponding to the longer slot 318A with length 318AL in the spout sleeve 312, which can permit a suitable rotation of the spout 304, as shown of 90°. Alternatively, the adjustment pin 310 can be inserted into the opening 316B of the adjustment sleeve 314 corresponding to the shorter slot 318B with length 318BL in the spout sleeve 312, which can permit a suitable rotation of the spout 304, as shown of 45°. Furthermore, as shown in FIGS. 16-17, the adjustment pin 310 can be inserted into the opening 316C of the adjustment sleeve 314 corresponding to the close-fitting circular opening 318C in the spout sleeve 312 to fix the spout sleeve 312 to the adjustment sleeve 314 and prevent rotation of the spout 304. For unrestricted 360° rotation of the spout 304 with respect to the base 302 in either the clockwise or counterclockwise direction, the adjustment pin 310 can be left out of the adjustment sleeve 314 and spout sleeve 312, such that it is not inserted in openings 316, 318. In this configuration, the spout 304 may be rotatable through multiple rotations of 360°.

As shown in FIGS. 14-17, the adjustment sleeve 314 can include multiple openings 316 for limiting rotation of the spout 304. For example, openings 316A, 316B can be located on one side of the adjustment sleeve 314 (as shown in FIGS. 14-15), while opening 316C can be located opposite openings 316A, 316B on an opposing side of the adjustment sleeve 314 (as shown in FIGS. 16-17). However, it will be appreciated that the openings 316, 318 in the adjustment sleeve 314 and spout sleeve 312 can be disposed at any suitable position and can be any suitable size.

Figure 18:
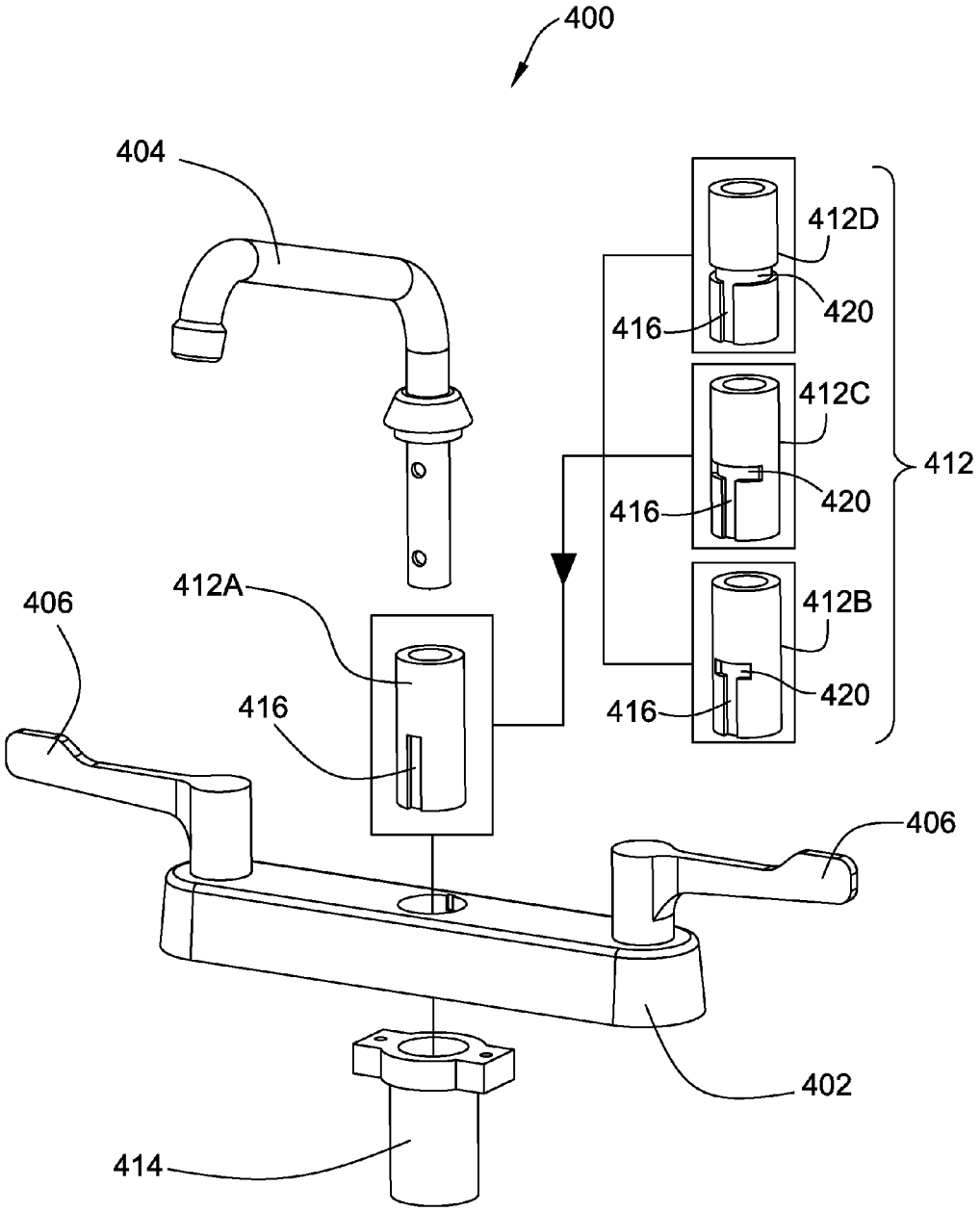
FIG. 18 is an exploded perspective view of a fourth embodiment of a faucet.

Another embodiment of a faucet 400 that can have the rotational range of motion of the spout 404 with respect to the base 402 chosen at the time of installation is shown in FIG. 18. A spout sleeve 412 can be attached to the spout 404, and the faucet base 402 can include an adjustment sleeve 414. The spout sleeve 412 can be cylindrical and can be disposed within an opening in the adjustment sleeve 414. The spout sleeve 412 can be fixed with respect to the spout 404, and the adjustment sleeve 414 can be fixed to the base 402.

In this embodiment, the installer can be provided with a kit containing a plurality of spout sleeves 412 that permit different ranges of rotational motion of the spout 404 with respect to the base 402. The installer can select between the plurality of spout sleeves 412 to choose the desired range of rotational motion. For example, as shown, spout sleeves 412A, 412B, 412C, 412D can be provided that permit the spout 404 to be fixed or permit rotation of 45°, 90°, or 360°. It will be appreciated, however, that the spout sleeve 412 can be manufactured to provide any suitable range of rotational motion between 0° and 360°, including through multiple rotations of 360°. It will also be appreciated that a single spout sleeve 412 can provide multiple ranges of rotational motion by, for example, having slots on opposing sides of the spout sleeve 412 that are sized to permit different ranges of rotational motion.

Figure 19:
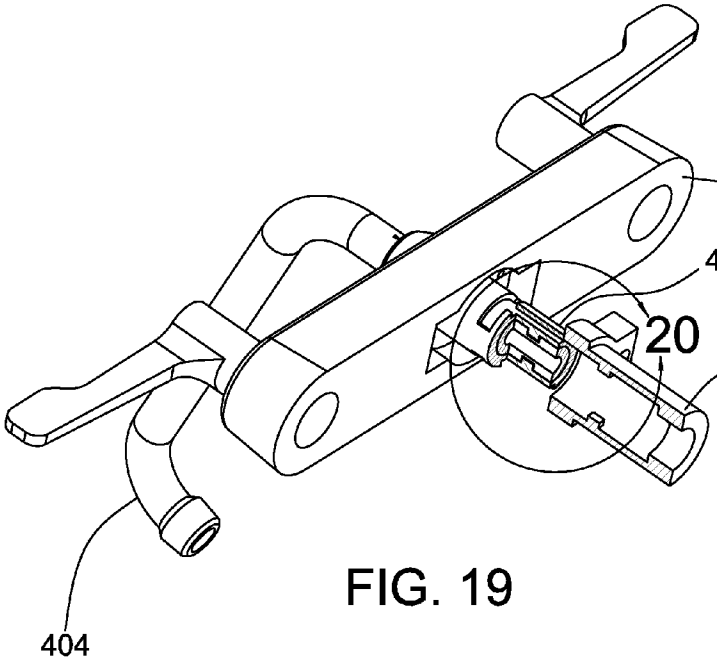
FIG. 19 is a perspective partial sectional view of the faucet of FIG. 18.
Figure 20:
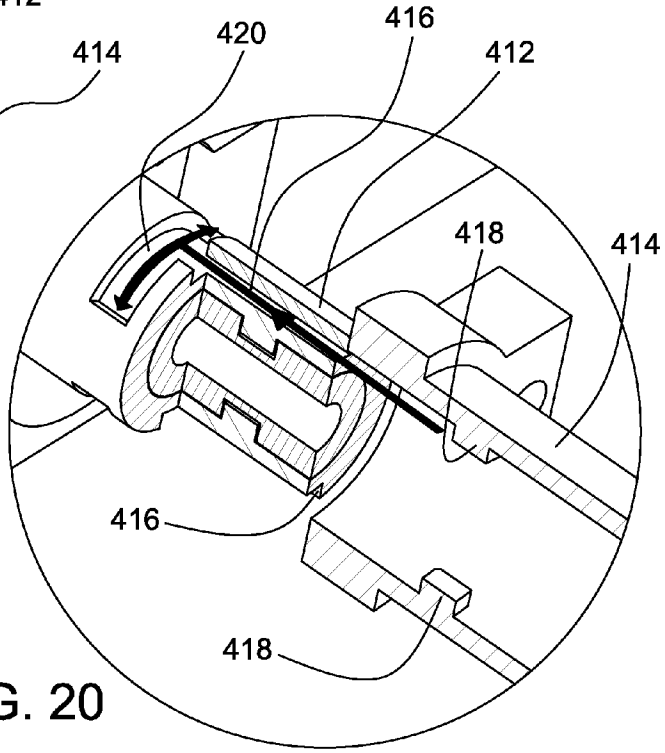
FIG. 20 is an enlarged fragmentary perspective partial sectional view of the faucet of FIG. 19.

Referring to FIGS. 18-20, each spout sleeve 412 can have one or more vertically disposed insert slots 416 that receive a corresponding tab 418 on the inner surface of the adjustment sleeve 414. For the fixed motion sleeve 412A, the insert slot 416 is approximately the thickness of the tab 418 such that when the tab 418 is disposed in the insert slot 416, the spout 404 is rotationally fixed with respect to the base 402. The sleeves 412B, 412C, 412D that permit rotation movement of the spout 404 have a horizontally disposed rotational slot 420 that is perpendicular to the insert slot 416 and sized to permit a desired degree of rotation of the spout 404 with respect to the base 402. As illustrated by the arrows in FIG. 20, once the tab 418 has been inserted fully through the insert slot 416 by moving the spout 404 and spout sleeve 412 combination into the adjustment sleeve 414, the spout 404 can rotate with the tab 418 disposed in the rotational slot 420. The tab 418 comprises an engagement structure and acts as a stop when it contacts the ends of the rotational slot 420 during rotation. Referring again to FIG. 18, sleeves 412B, 412C, 412D with rotational slots 420 providing 45°, 90°, and 360° rotation, respectively, can be provided. It will be appreciated, however, that the engagement structure provided by rotational slots 420 can be sized to permit any suitable degree of rotation of the spout 404 with respect to the base 402, and any suitable number of spout sleeves 412 permitting different rotational ranges of motion of the spout 404 with respect to the base 402 can be provided in a kit for an installer to choose between.

Figure 21:
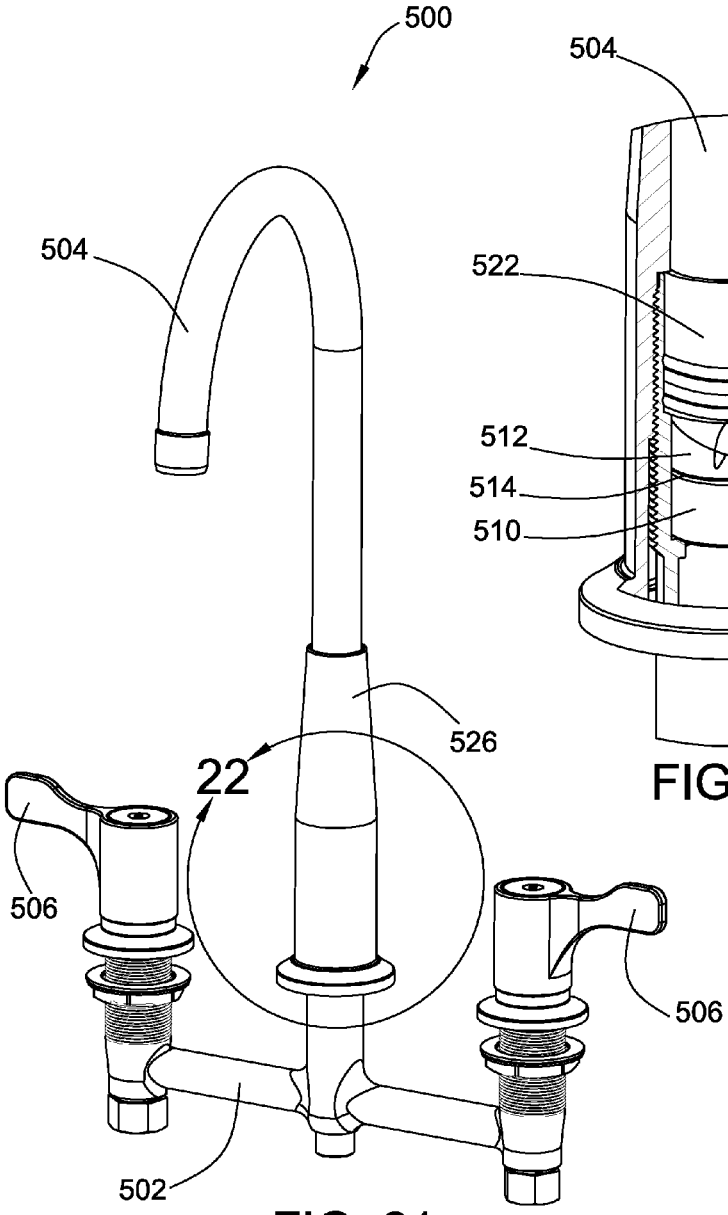
FIG. 21 is a perspective view of a fifth embodiment of the faucet.
Figure 22:
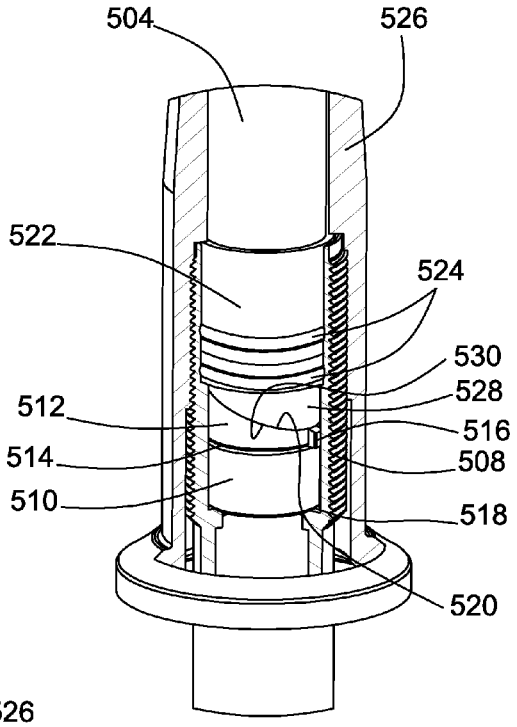
FIG. 22 is a fragmentary partial sectional view of the faucet of FIG. 21.
Figure 23:
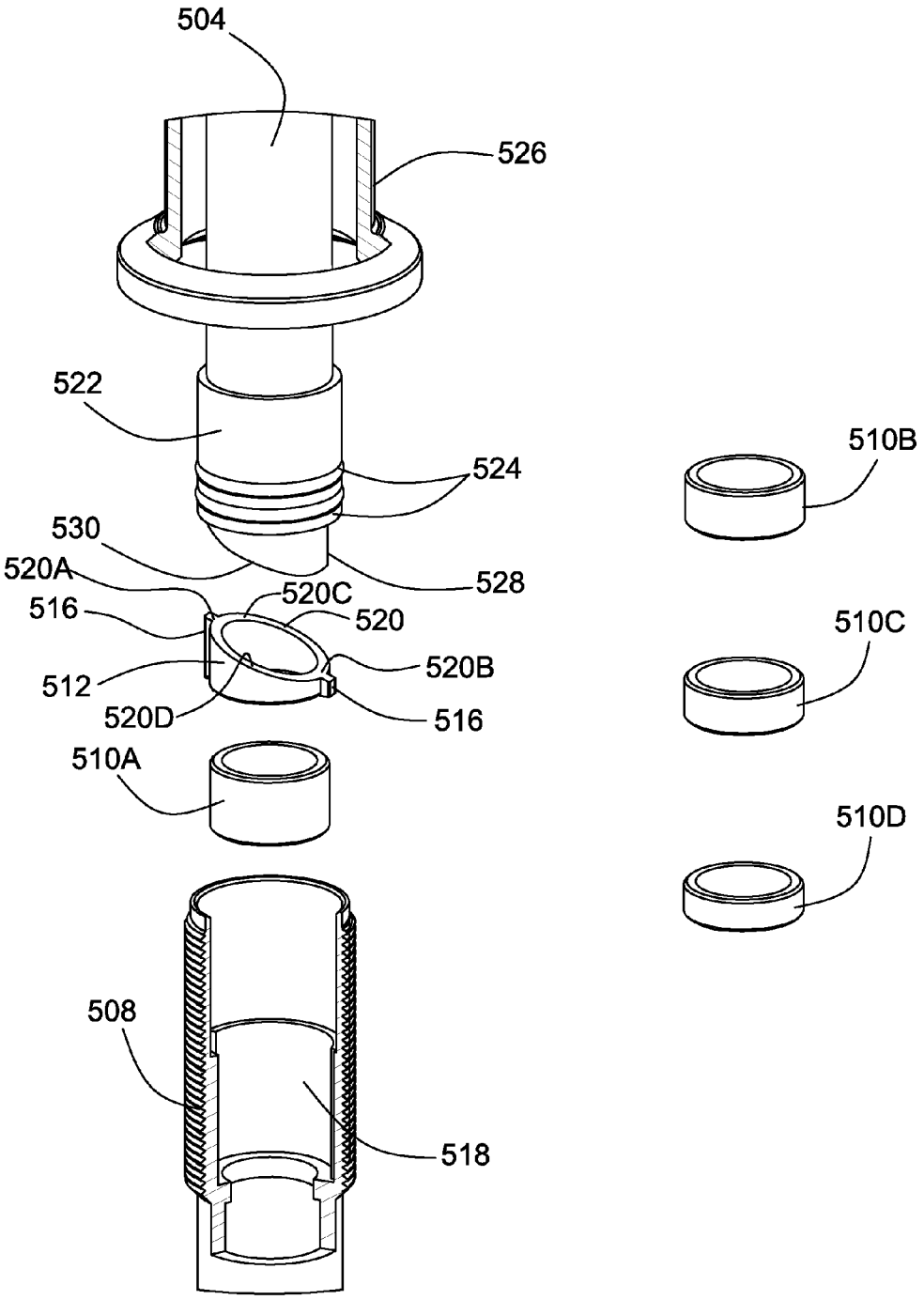
FIG. 23 is an exploded partial perspective view of the faucet of FIG. 21.
Figures 24, 25, 26, 27:
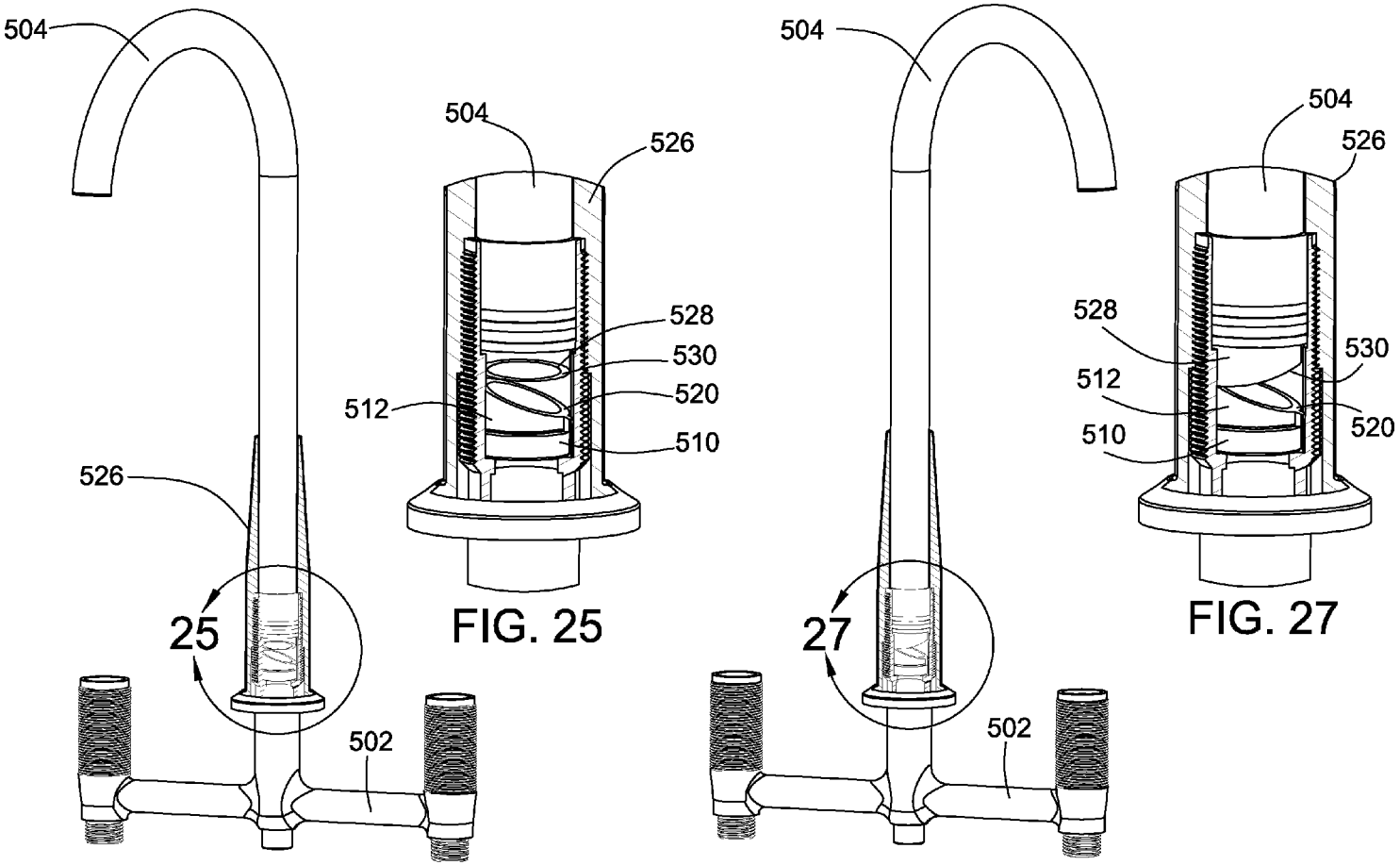
FIG. 24 is a perspective view of the faucet of FIG. 21.
FIG. 25 is an enlarged fragmentary partial sectional view of the faucet of FIG. 24 adjusted to permit a degree of rotation between the spout and the faucet base.
FIG. 26 is a perspective view of the faucet of FIG. 21.
FIG. 27 is an enlarged fragmentary partial sectional view of the faucet of FIG. 26 adjusted to permit a degree of rotation between the spout and the faucet base.

Another embodiment of a faucet 500 that can have the rotational range of motion of the spout 504 with respect to the base 502 chosen at the time of installation is shown in FIGS. 21-22. The base 502 can have a cylindrical wall 508 forming an opening 518 for receiving the spout 504. The cylindrical wall 508 can include internal threads and/or external threads. The cylindrical wall 508 can include one or more grooves. A spacer 510 can be provided that fits within the opening 518. A rotation-limiting element 512, such as a cam, may also be provided. The rotation-limiting element 512 can be received in the opening 518 and can have a base surface 514 that rests on the spacer 510. The rotation-limiting element 512 can have one or more projections 516 that engage the one or more grooves in the wall 508 to prevent the rotation-limiting element 512 from rotating within the opening 518. The groove(s) can slidably receive the projection(s) 516. The rotation-limiting element 512 can include a first engagement structure which may include a first engagement surface 520 for engaging a projection at the base-end the spout 504 to restrict rotation of the spout relative to the base. The first engagement surface 520 can be in the foam of a ramp, such that when viewed from the side, the first engagement surface 520 can have a high point 520A and a low point 520B. The high point 520A and low point 520B can be connected. For example, two opposing semi-circular elements 520C, 520D can smoothly connect high point 520A to low point 520B to form first engagement surface 520. When viewed from above, high point 520A can be closer to the spout 504 than low point 520B, as shown in FIG. 23. It will be appreciated, however, that the rotation-limiting element 512 can have any suitable shape and size to enable any suitable degree of rotation of the spout 504 with respect to the base 502.

The spout 504 can have a cylindrical outer surface with a raised portion 522 featuring one or more grooves for receiving O-ring seals 524. A retainer, such as threaded collar 526, can be disposed over the spout 504 and the base 502. The threaded collar 526 can be screwed onto the external threads of the cylindrical wall 508 of the base 502. The collar 526 can contact the raised portion 522 of the spout 504, which extends outward from the cylindrical outer surface of the spout 504, to retain the spout 504 to the base 502. The spout 504 can have a spout end 528, i.e., at the base-end of the spout 504, that can include a second engagement structure which may include a second engagement surface 530 for engaging the rotation-limiting element 512 to restrict rotation of the spout 504. The second engagement surface 530 can be in the form of a ramp that is complementary to the ramp of the rotation-limiting element 512. For example, the shape of the second engagement surface 530 of the spout end 528 can be the same as the first engagement surface 520 of the rotation-limiting element 512. It will be appreciated, however, that the first and second engagement surfaces 520, 530 can have any suitable shape and size to enable any suitable degree of rotation of the spout 504 with respect to the base 502, as explained below.

The range of rotation of the spout 504 with respect to the base 502 can be chosen by the installer at the time of installation. Referring to FIG. 23, in order to set the desired range of rotation, the installer can perform the following steps. A spacer 510 can be disposed in the cylindrical opening 518 of the base. The spacer 510 can be chosen from among a plurality of spacers 510A, 510B, 510C, 510D of different thicknesses or heights. The rotation-limiting element 512 can also be disposed in the cylindrical opening 518 such that the rotation-limiting element 512 rests on the spacer 510. The different thickness spacers 510A, 510B, 510C, 510D permit the rotation-limiting element 512 to be raised or lowered to a desired position within the cylindrical opening 518. The spout end 528 can then be inserted into the cylindrical opening 518 of the base 502 and the collar 526 can be used to retain the spout 504 in place. The position of the spout end 528 with respect to the rotation-limiting element 512 determines the degree of rotation of the spout 504 with respect to the base 502.

For example, referring to FIGS. 24-27, the spacer 510 can be selected to create varying amounts of separation between the first engagement surface 520 of the rotation-limiting element 512 and the second engagement surface 530 of the spout end 528. More particularly, the spout 504 can rotate with respect to the base 502 until the first engagement surface 520 of the rotation-limiting element 512, which is fixed with respect to the faucet base 502, rotates into abutting contact with the second engagement surface 530 of the spout end 528, which is fixed with respect to the spout 504. The amount of separation between the first engagement surface 520 and the second engagement surface 530 affects to what extent the spout 504 can rotate with respect to the faucet base 502 before the first engagement surface 520 contacts the second engagement surface 530. Using a shorter spacer (such as spacer 510D in FIG. 23) creates larger separation resulting in a greater degree of rotation of the spout 504. Using a taller spacer (such as spacer 510B in FIG. 23) creates smaller separation resulting in a smaller degree of rotation of the spout 504. Thus, the range of permissible rotation is variable and the installer has flexibility in choosing a desired rotational range by selecting the appropriate spacer 510. In the configuration shown in FIGS. 24-27, the spout 504 can be rotated, for example, from 0° to 180° with respect to the base 502. Other spacers 510, such as those shown in FIG. 23, can permit other ranges of rotation of the spout 504, such as, for example, 45° and 70°.

Figure 28:
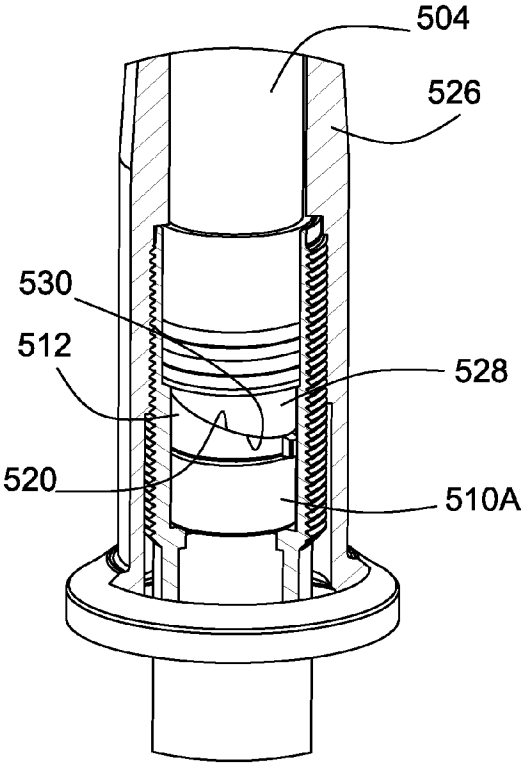
FIG. 28 is an enlarged fragmentary partial sectional view of the faucet of FIG. 21 adjusted to prohibit rotation between the spout and the faucet base.

Referring to FIG. 28, when the tallest spacer 510A is used, the first and second engagement surfaces 520, 530 are fully in contact with one another, i.e., there is no separation between the first engagement surface 520 and the second engagement surface 530. In this configuration, the spout 504 cannot be rotated with respect to the base 502. The fixed relation between spout 504 and base 502 is equivalent to 0° of rotation.

Figure 30:
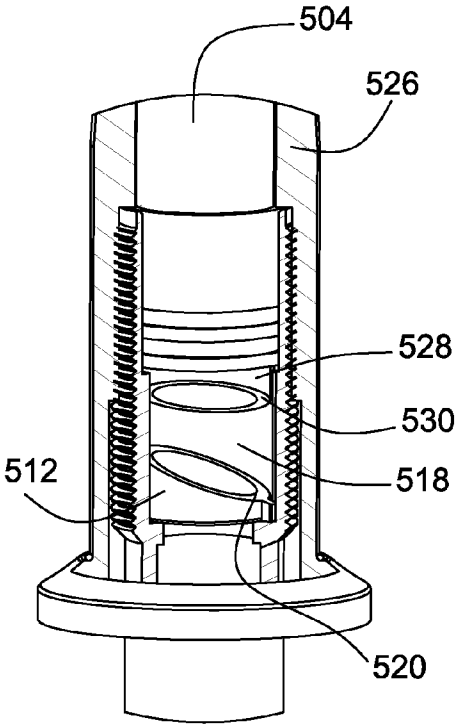
FIG. 30 is another enlarged fragmentary partial sectional view of the faucet of FIG. 21 adjusted to permit 360° of rotation between the spout and the faucet base.
Figure 29:
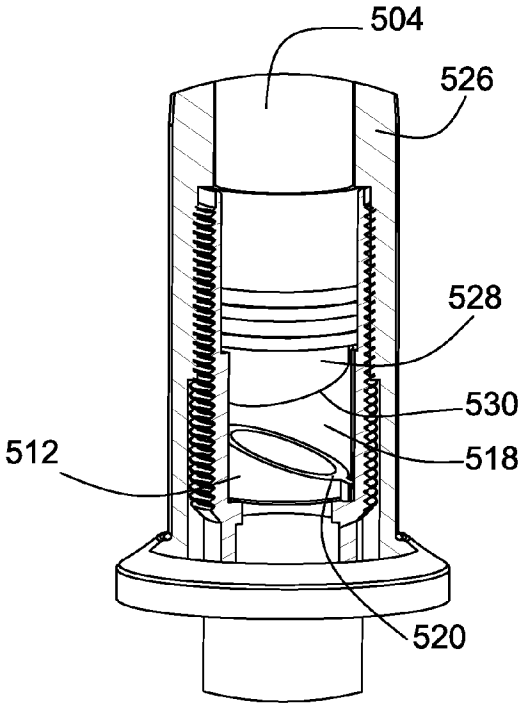
FIG. 29 is an enlarged fragmentary partial sectional view of the faucet of FIG. 21 adjusted to permit 360° of rotation between the spout and the faucet base.

Referring to FIGS. 29-30, at the time of installation the installer can choose to not use a spacer. Without a spacer in the opening 518 of the base 502, the rotation-limiting element 512 is lowered to an extent that the first and second engagement surfaces 520, 530 do not contact one another. In this configuration, the spout 504 can be rotated freely a full 360° with respect to the base 502 in either the clockwise or counterclockwise configuration, and through multiple rotations of 360°.

A faucet is described herein that provides an installer with the ability to select between any of a plurality of different rotational ranges of a spout with respect to a base. The installer can select between any range of rotational motion between 0° and 360°, inclusive, in either the clockwise or counterclockwise direction. When the degree of rotation is 360°, the spout may rotate through multiple rotations of 360°. The range of permissible rotation of the spout can be variable such that the installer has flexibility in setting the rotational range of motion. Alternatively, the installer may be provided with several permissible ranges of motion selected by the manufacturer of the faucet, any of which can then be selected by the installer at the time of installation.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A faucet, comprising:

a faucet base having an opening;

a rotation-limiting element receivable in the opening, the rotation-limiting element having a first engagement structure;

a spout with an end receivable in the opening, the end of the spout having a second engagement structure;

a retainer that surrounds the spout for retaining the spout and rotation-limiting element in the opening, the spout being selectively rotatable in a clockwise direction and a counterclockwise direction within the retainer from a first position where the first engagement structure is in contact with the second engagement structure, through a degree of rotation throughout which the first and second engagement structures are spaced a distance apart, to a second position where the first engagement structure is in contact with the second engagement structure, the degree of rotation being variable by adjusting the distance the first and second engagement structures are spaced apart, and the spout being fully rotatable through 360° when the first and second engagement structures do not contact each other, and being non-rotatable with respect to the base when the first and second engagement structures are maintained in contact, and a spacer receivable in the opening below the rotation-limiting element, wherein the spacer adjusts the distance between the first engagement structure and the second engagement structure.

2. The faucet of claim 1, wherein the first rotation-limiting element is fixed with respect to the faucet base.

3. The faucet of claim 1, wherein the spacer decreases the distance between the first engagement structure and the second engagement structure when the first and second engagement structures are spaced apart, thereby decreasing the degree of rotation.

4. The faucet of claim 1, wherein the spacer is selected from among a plurality of spacers of different thicknesses, each of the plurality of thicknesses corresponding to a particular range of rotation of the spout relative to the faucet base by adjusting the distance between the first engagement structure and the second engagement structure when the first and second engagement structures are spaced apart.

5. The faucet of claim 1, wherein the spacer is selected from one of a plurality of spacers, each with a different thickness and each corresponding to a different degree of rotation.

6. The faucet of claim 1, wherein the spacer is an adjusting nut movable within the retainer.

7. The faucet of claim 6, wherein the second engagement structure is mounted to the end of the spout so as to be rotatable therewith.

8. The faucet of claim 1, wherein the first engagement structure and the second engagement structure have complementary surfaces each in the form of a ramp, each ramp having a high point and a low point, wherein on the ramp of each engagement structure the high point is connected to the low point by opposing semi-circular elements.

9. The faucet of claim 8, wherein the spout is non-rotatable with respect to the base in either the clockwise direction or the counterclockwise direction when the complementary surface of the first engagement structure abuts the complementary surface of the second engagement structure.

10. A kit for a faucet installation, the kit comprising:

a faucet base having an opening;

a rotation-limiting element receivable in the opening, the rotation-limiting element having a first engagement structure;

a spout with an end receivable in the opening, the end of the spout having a second engagement structure;

a retainer that surrounds the spout for retaining the spout and the rotation-limiting element in the opening, the spout being selectively rotatable within the retainer through a degree of rotation, the degree of rotation being variable by adjusting the distance the first and second engagement structures are spaced apart;

a spacer receivable in the opening below the rotation-limiting element, the spacer being selected from one of a plurality of spacers, each with a different thickness and each corresponding to a different degree of rotation.

11. A method for installing a faucet, comprising:

disposing a rotation-limiting element in an opening of a faucet base, the rotation-limiting element having a first engagement structure;

disposing a spout in the opening of the faucet base above the rotation-limiting element, the spout having a second engagement structure and being selectively rotatable in a clockwise direction and a counterclockwise direction;

retaining the spout and the rotation-limiting element in the opening with a retaining structure that surrounds the spout; and adjusting a distance between the first engagement structure and the second engagement structure to vary a degree of rotation of the spout with respect to the faucet base, the spout being fully rotatable through 360° when the first and second engagement structures do not contact each other, and being non-rotatable with respect to the base when the first and second engagement structures are maintained in contact, wherein adjusting the distance between the first engagement structure and the second engagement structure comprises disposing a spacer within the opening of the faucet base.

12. The method of installing a faucet of claim 11, wherein the degree of rotation is more than 0° but less than 360°.

13. The method of installing a faucet of claim 11, further comprising disposing the spacer beneath the rotation-limiting element.

* * * * *